US006457990B1

(12) United States Patent
Daoud

(10) Patent No.: US 6,457,990 B1
(45) Date of Patent: Oct. 1, 2002

(54) INSULATION DISPLACEMENT CONNECTOR RETAINING LATCH MEMBER

(75) Inventor: Bassel H. Daoud, Parsippany, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/217,092

(22) Filed: Dec. 21, 1998

(51) Int. Cl.[7] ..... H01R 4/24
(52) U.S. Cl. ..... 439/409
(58) Field of Search ..... 439/409, 410, 439/417

(56) References Cited

U.S. PATENT DOCUMENTS

| | | | | | |
|---|---|---|---|---|---|
| 3,594,696 | A | * | 7/1971 | Witek | |
| 3,611,264 | A | | 10/1971 | Ellis | |
| 4,426,125 | A | * | 1/1984 | Crawford | |
| 4,662,699 | A | | 5/1987 | Vachhani et al. | |
| 4,684,195 | A | * | 8/1987 | Anderson et al. | 439/409 |
| 4,793,823 | A | | 12/1988 | Cozzens et al. | 439/409 |
| 5,092,493 | A | * | 3/1992 | Pehr | 222/153 |
| 5,240,432 | A | * | 8/1993 | Daoud | 439/417 |
| 5,306,178 | A | * | 4/1994 | Huang | 174/67 |
| 5,637,011 | A | | 6/1997 | Meyerhoefer et al. | 439/409 |
| 5,681,182 | A | * | 10/1997 | Reichie | 439/417 |
| 5,855,492 | A | * | 1/1999 | Abe et al. | 439/409 |
| 5,860,829 | A | | 1/1999 | Hower et al. | 439/417 |
| 5,957,720 | A | * | 9/1999 | Boudin | 439/417 |

OTHER PUBLICATIONS

Technical Data Sheet of A.C. Egerton Limited, related to Mini Rocker Cross Connection Cabinets.

* cited by examiner

*Primary Examiner*—Neil Abrams
(74) *Attorney, Agent, or Firm*—Stroock & Stroock & Lavan LLP

(57) ABSTRACT

A tool-less insulation displacement connector comprising a moveable wire receiving portion having a front face and a rear side, the front face having a bottom edge, a top edge and two opposite sides; and a hinged latch having a cross member hingedly connected to the moveable portion and oriented above the top edge of said front face, the cross member having two downwardly projecting arms bordering the front face proximate the opposite sides, the cross member having an inwardly projecting recess oriented above the front face and separated from the front face by a channel, the front face being sloped inward such that the bottom edge is farther from the rear side than is the top edge, the recess having a depth that is at its greatest proximate the channel, the recess and a portion of the sloped front face together defining a recessed tactile feedback area within which a portion of a digit of a user may rest when operating the connector.

13 Claims, 5 Drawing Sheets

INSULATION DISPLACEMENT CONNECTOR RETAINING LATCH MEMBER

FIELD OF THE INVENTION

This invention relates to an Insulation Displacement Connector, and in particular, to a connector having an improved retaining latch member design.

BACKGROUND OF INVENTION

In a telephone network, a network cable from the central office is connected to a building entrance protector (BEP) located at the customer site, where the individual telephone lines are broken out line by line. The network cable, which consist of a plurality of tip-ring wire pairs that each represent a telephone line, is typically connected to a connector block that is an integral part of the BEP. Such connectors may be, for example, the ubiquitous 66-type punch down connector, or an SC 99 type connector block, such as are available from Lucent Technologies Inc., or the mini rocker tool-less insulation displacement (IDC) type connector, such as for example those sold by A. C. Egerton, Ltd. Other connectors used for telephony wiring applications are described in U.S. Pat. No. 4,662,699 to Vachhani et al., dated May 5, 1987, and in U.S. Pat. No. 3,611,264 to Ellis, dated Oct. 5, 1971.

A mini-rocker connector generally has a movable top section which comprises two wire insertion holes and a lower fixed section which houses a pair of terminal strips. The terminal strips have a wire engaging portion at one end for engaging and making electrical contact with a wire. The terminal strips are generally parallel to one another but offset to provide a sufficient dielectric strength between them. In order to make the connector as small as possible, as a matter of design choice, the terminal strips are moved as close together as possible while maintaining good dielectric strength.

The top movable section of the connector pivots about a fixed axis located towards the back side of the connector. The top section has a movable latch member to maintain the top section in its closed position. To open the top section, a user releases the latch member and pivots the top section to its open position. When the top section is open, the terminal strips do not intersect the wire insertion holes, and when the top section is closed, the terminal strips intersect the wire insertion holes. In order to establish an electrical connection between the wires and the terminal strips a user first opens the top section, i.e., pivots the top section to its open position, inserts the pair of wires, and then closes the top section. Upon closing the top section of the connector, the wires are forced through the terminal strip engaging portion to make electrical and mechanical contact with the terminal strips. To remove the wires and/or break the electrical connection, the process is reversed.

The prior art connector latch member is a substantially flat square design. Technicians who manually unlatch a connector may accidentally also unlatch a neighboring connector. Such accidental opening often occurs because the soft tissue portion of the technician's thumb may extend past the connector to be opened and cover part of the adjacent connector. That is, the prior art latch design does not adequately orient or position a technician's thumb or other finger when the technician attempts to open the connector. The present invention is directed at overcoming shortcomings of the prior art connectors.

SUMMARY OF THE INVENTION

Generally speaking, in accordance with the instant invention, an improved connector latch member is provided.

The latch member is formed generally as an inverted U-shaped member, and comprises atop crossbar member connected to two downwardly projecting arms or side members. Each of the side members of the latch comprise an engaging portion on the lower back side thereof for engaging a corresponding retention member on a downwardly facing section of the connector. To disengage the side member engaging portions, a technician generally grips and squeezes between thumb and forefinger the crossbar member and a finger grip portion on the back side of the connector top section. Upon squeezing, the crossbar member rotates slightly about a living hinge whereupon the engaging members are disengaged from the corresponding retention members, and the top section of the connector may then be pivoted upwards into its open position.

The two side members generally intersect the crossbar member at right angles. In accordance with a preferred embodiment of the present invention, when viewed from the front, the top outside corners of the latch member are rounded off. Further, when viewed from the front, the inside corners of the latch member are tapered such that the inside corners of the latch member, i.e., where the side members meet the crossbar member, are sloped rather than at right angles. Also, the crossbar member and side members are tapered inwards such that the inside edges of the latch are recessed from the outside edges of the latch. That is, when seen in front elevation the crossbar and side members form a trapezoidal shape. In a preferred embodiment, the trapezoidally sloped portion of the crossbar member has a recessed latch grip portion formed in it at the approximate center thereof. That is, the latch grip portion is a recess formed in the front face of the crossbar member, essentially centered between the two side members.

When so constructed, the connector of the present invention aids in orienting and positioning the soft tissue of a technician's thumb on the connector latch member, providing positive tactile feedback and thereby reducing the likelihood of accidentally opening an adjacent connector. Also, when so constructed, the connector of the present invention increases the physical and visible separation between adjacent connectors.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWINGS

In the drawing figures, which are not to scale, and which are merely illustrative, and wherein like reference numerals depict like elements throughout the several views.

DESCRIPTION OF A PREFERRED EMBODIMENT

Generally speaking, in accordance the instant invention, an improved connector latch member is provided which aids in orienting and positioning a technician's thumb on the connector latch member, thereby reducing the likelihood of accidentally opening an adjacent connector.

Figure 1:
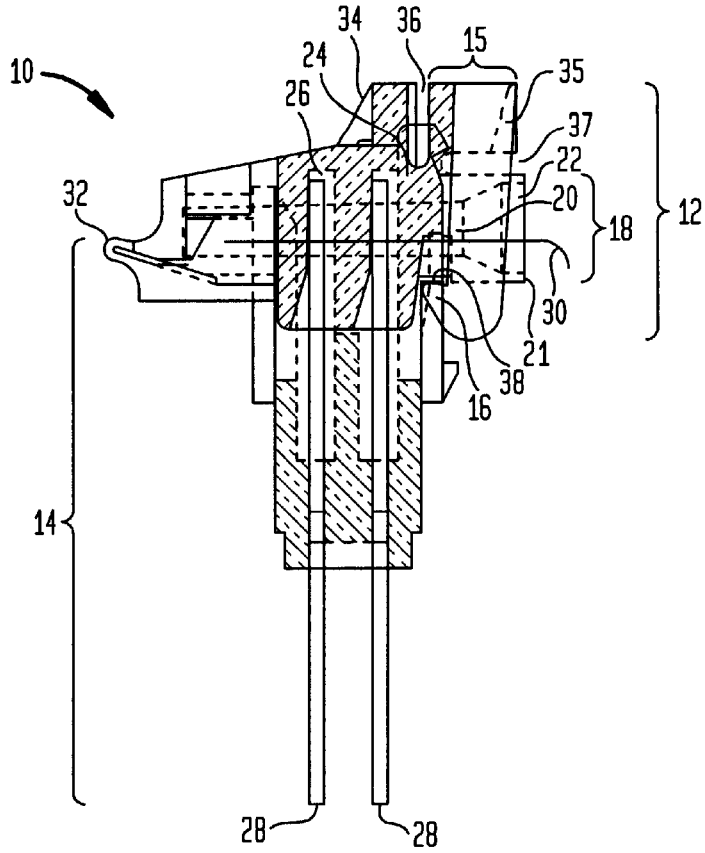
FIG. 1 (PRIOR ART)
FIG. 1 is a side sectional view of a connector constructed in accordance with the prior art.
Figure 2:
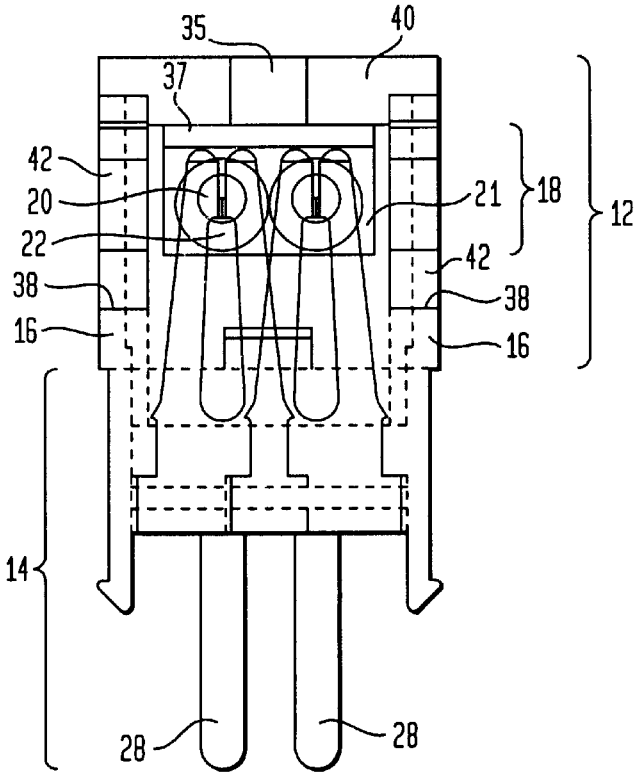
FIG. 2 (PRIOR ART)
FIG. 2 is a front elevational view of the prior art connector of FIG. 1.

As seen in FIGS. 1 and 2, a prior art connector, generally indicated as 10, has a cap forming a top section, generally indicated as 12, movable between an open position (not shown) and a closed position, and a bottom fixed section, generally indicated as 14. The top section 12 generally comprises a wire retention portion 18 which comprises a substantially rectangular front face 21 having two entrance apertures 22 therein, which lead to two wire insertion holes 20. The top edge of wire retention portion 18 is defined by channel 37. Wire insertion holes 20 are constructed so as to accept wire 30 in a manner known in the art. Top section 12 also has terminal strip receiving portions 26, which are constructed to accept terminal strips 28 when the top section 12 is in its closed position.

As seen in FIG. 1, when top section 12 is in its closed position, terminal strips 28 intersect wire insertion holes 20, and when top section 12 is in its open position (not shown), terminal strips 28 do not intersect wire insertion holes 20. In order to establish an electrical and mechanical connection between the wire 30 and the terminal strip 28, a user first opens the top section 12, i.e., pivots top section 12 about hinged axis 32 to its open position, inserts a wire 30, and then closes the top section 12. Upon closing top section 12 of connector 10, wire 30 is brought into electrical and mechanical contact with terminal strip 28. To remove the wire and/or break the electrical connection, the process is reversed.

As seen in FIG. 1, the top movable section 12 comprises a latch, generally indicated as 15, movable between an engaged position and a disengaged position. Latch 15 generally comprises a crossbar member 40 connected to two downwardly projecting side members 42. As seen in FIG. 1, when top section 12 is in its closed position and the latch 15 is in its engaged position, latch engaging portion 16 engages latch retaining portion 38 on the bottom section 14 of the connector 10. Thus, when the top section 12 is in its closed position and the latch is in its engaged position, the latch 15 maintains top section 12 in its closed position. In order to open top section 12, latch 15 must first be moved to its disengaged position.

To move latch 15 between its engaged position and its disengaged position, a user generally grips the connector between a rear finger grip portion 34 and latch grip portion 35 which forms part of the front face of latch 15. Upon squeezing or other pressure, crossbar member 40 of latch 15 pivots about living hinge 24 away from channel 37 and towards recess 36. Latch 15 is pivoted about living hinge 24 into recess 36 a sufficient distance so as to disengage latch engaging portion 16 from latch retaining portion 38. Once latch engaging portion 16 is disengaged from latch retaining portion 38, top section 12 is able to move to its open position.

As seen in FIGS. 1 and 2, the front face 21 of wire retention portion 18 extends beyond the front face of latch 15. Also, the front faces or surfaces of the prior art latch are generally flat, planar surfaces that are perpendicular to the longitudinal axis of insertion holes 20. Also, as seen in FIG. 1, the front face 21 of wire retention portion 18 is substantially vertical when viewed from the side. Thus, when a technician grips the prior art connector to open its top section, the technician's thumb will generally press on the small latch grip portion 35 and the front face 21 of wire retention portion 18 with little or no tactile feedback indicating the person's fingers are correctly positioned.

Figure 3:
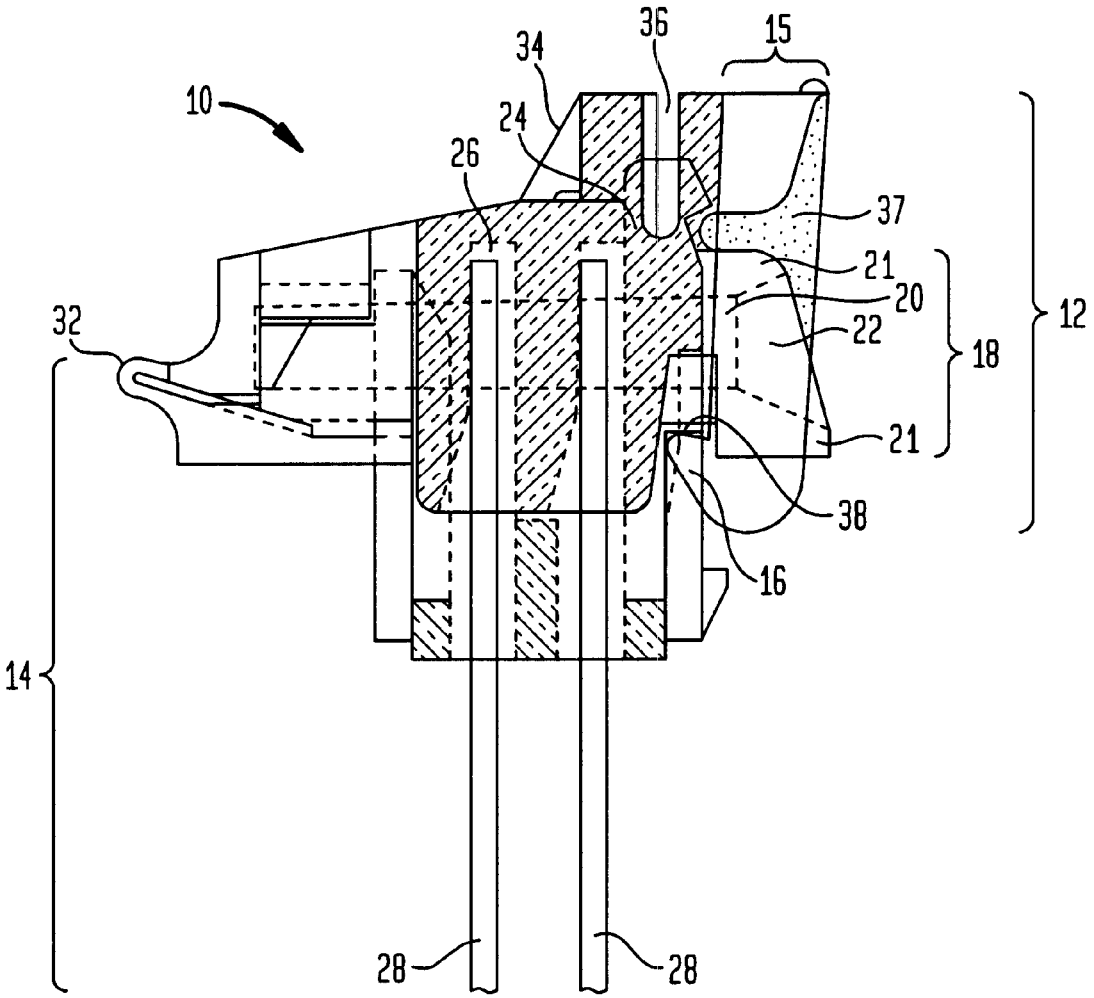
FIG. 3 is a side sectional view of a connector constructed in accordance with a preferred embodiment of the present invention.
Figure 4:
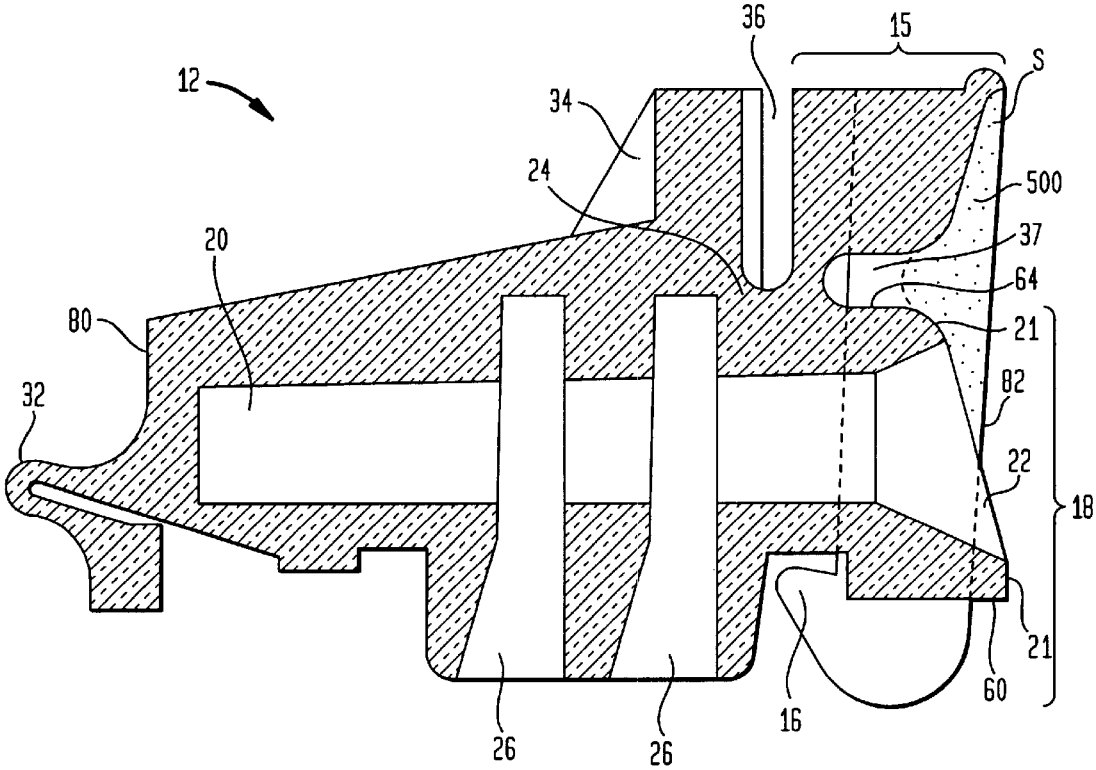
FIG. 4 is a side sectional view of the top section of the connector of FIG. 3.
Figure 5:
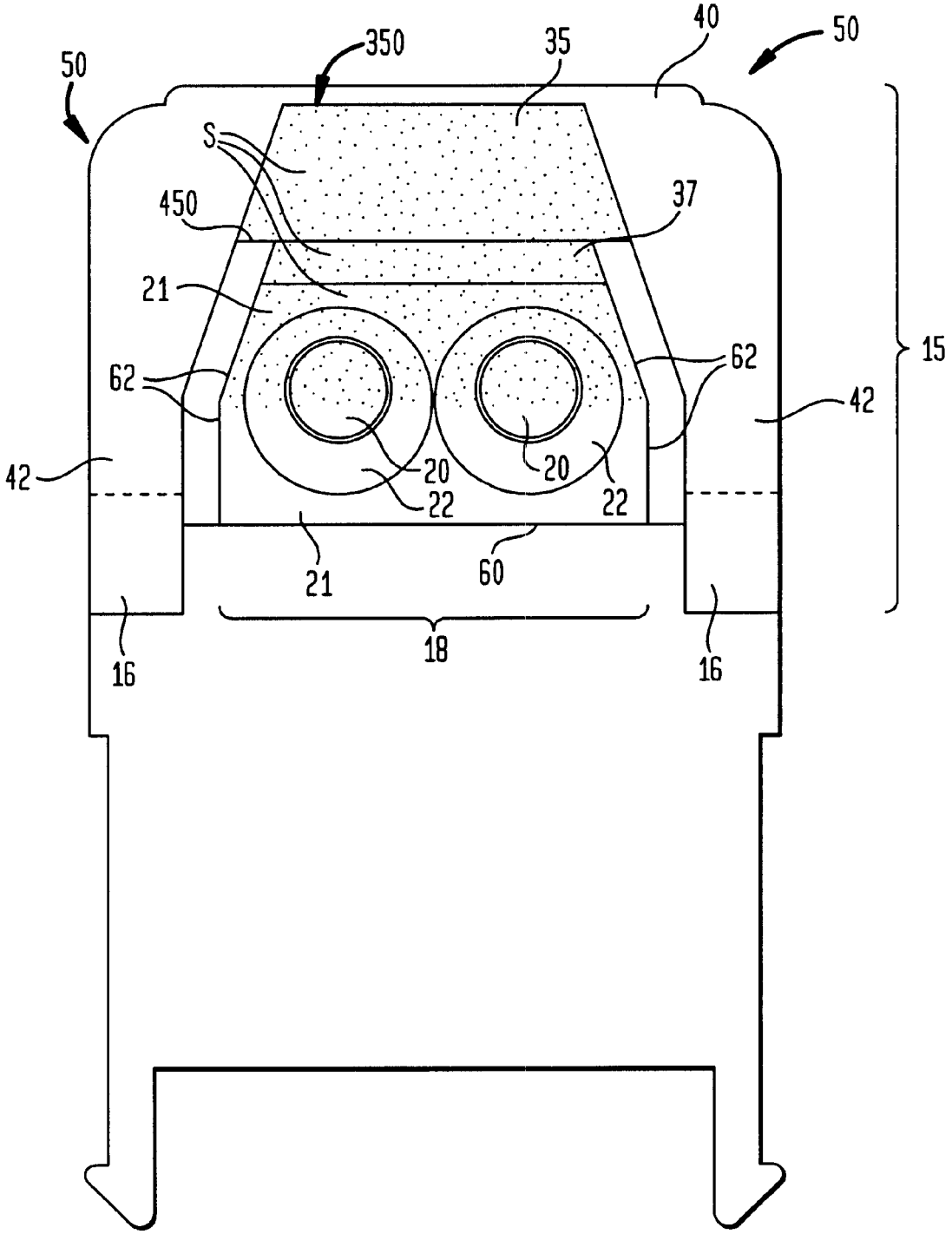
FIG. 5 is a front elevational view of the connector of FIG. 3.

FIGS. 3–5 depict a connector constructed in accordance with a preferred embodiment of the present invention. As seen in FIG. 3, the connector of the present invention, generally indicated as 10, has a top section generally indicated as 12, movable between an open position and a closed position, and a bottom fixed section, generally indicated as 14. The top section 12 generally comprises a wire retention portion 18 which comprises a front face 21 having two entrance apertures 22 therein, which lead to two wire insertion holes 20. As best seen in FIGS. 4 and 5, wire retention portion 18 is defined by a bottom surface 60, side surfaces 62, and top surface 64, which is defined by the bottom surface of channel 37. Top section 12 also has terminal strip receiving portions 26, which are constructed to accept terminal strips 28 when the top section 12 is in its closed position. As seen in FIG. 3, when top section 12 is in its closed position, terminal strips 28 intersect wire insertion holes 20, and when top section 12 is in its open position (not shown), terminal strips 28 do not intersect wire insertion holes 20.

As seen in FIG. 4, the top movable section 12 comprises a latch, generally indicated as 15, movable between an engaged position and a disengaged position (not shown). The latch member 15, as more fully described below, is generally sloped as an inverted U, and comprises a lop crossbar member 40 connected to two downwardly projecting arms or side members 42. Each of the side members 42 of the latch 15 comprise an engaging portion 16 on the backside thereof for engaging a corresponding retention member 38 on the bottom section of the connector. To disengage the side member engaging portions 16, a technician generally grips and squeezes the crossbar member 40 and a finger grip portion 34 on the back side of the connector top section 12 between the thumb and forefinger. Upon squeezing or other pressure, latch 15 pivots about living hinge 24 away from channel 37 and towards recess 36. Latch 15 is pivoted about living hinge 24 into recess 36 a sufficient distance so as to disengage latch engaging portion 16 from latch retaining portion 38. Once latch engaging portion 16 is disengaged from latch retaining portion 38, top section 12 is able to move to its open position.

As highlighted by the shaded portions S of FIG. 4, the front face 21 of wire retention portion 18 is angled backward when seen in side view toward rear side 80 of top section 12. Thus, the bottom edge of front face 21 extends outward beyond the front face 82 of latch 15, while the top edge of front face 21 does not extend beyond the front face 82 of latch 15. Referring now to FIGS. 4 and 5, the two side members 42 generally intersect the crossbar member 40 at right angles. In accordance with a preferred embodiment of the present invention, when viewed from the front, the top outside corners 50 of the latch member 15 are rounded off. Further, when viewed from the front, the inside corners of the latch member 15 are tapered such that the inside comers of the latch member 15, i.e., where the side members 42 meet the crossbar member 40, are not at right angles. In a preferred embodiment, the crossbar member 40 also comprises a large recessed latch grip portion 35 that is formed preferably as a trapezoidal recess formed in the front face of the crossbar member 40, essentially centered between the two side members 42. Recess 35 has a depth that, when seen in side view, increases from the top of the recess 350 to the bottom of the recess 450, having its greatest depth proximate channel 37 (FIG. 4).

As seen in the shaded areas S of FIGS. 4 and 5, when a technician grips the connector of the present invention to open its top section, the technician's thumb will generally press against the shaded region S, which region forms a large recessed area 500 made up of recess 35 and the sloped front face 21 of wire retention portion 18. This large recessed area 500 is more readily felt by the user, as more of the person's thumb (or other digit) will occupy it. Thus recessed area 500 provides for more effective tactile feedback when operating connector 10. This improves operability and reduces the likelihood of unintended disengaging of the latch. One of skill in the art will recognize that, when constructed as such, the connector of the present invention aids in orienting and positioning the soft tissue of a technician's thumb or other digit on the connector latch member, thereby reducing the likelihood of accidentally opening an adjacent connector.

Figure 6:
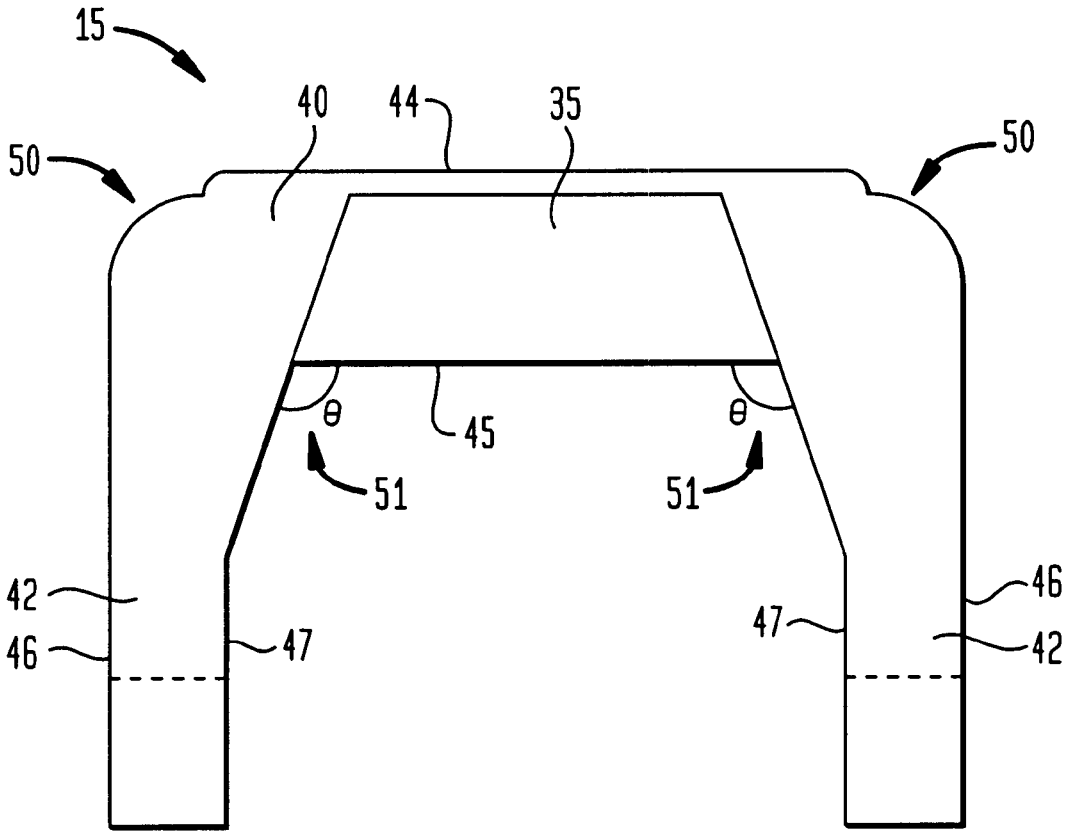
FIG. 6 is a front elevational view of the latch member of FIG. 3.

As seen in FIG. 6, latch 15 of the present invention generally comprises a top crossbar member 40 connected to two downwardly projecting side arms or members 42. Crossbar 40 has a top side 44 and a bottom side 45. Crossbar 40 also has a latch grip portion 35. Side arms 42 have outer sides 46 and inner sides 47. As seen in FIG. 6, when viewed from the front, the outside corner 50 where the top side 44 of crossbar 40 intersects the outer side 46 of side arms 46 is rounded off, i.e., not square or at a right angle. Also, as seen in FIG. 6 when viewed from the front, the bottom side 45 of crossbar 40 intersects the inner sides 47 of side arms 42, forming inner comers 51. Inner corners 51 are obtuse angles θ. That is, the upper ends of side arms 42 are tapered inwards such that the inner comers 51 form an obtuse angle θ. In a preferred embodiment, θ is somewhere between 100 and 120 degrees, and preferably equal to about 110 degrees. One of skill in the art will recognize that the structure of the latch member also aids in correctly positioning the user's fingers for opening the connector. Also, when so constructed with the rounded off outer corners, the connector of the present invention increases the perception of the physical and visible separation between adjacent connectors.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A too-less insulation displacement connector comprising:

a top section and a bottom section, said top section being movable between an open position and a closed position;

a latch member comprising a crossbar member extending between two downwardly projecting side arm members;

said crossbar member having an upper side and a lower side, and said side arm members each having an outer side, an inner side, a front side and a rear side;

said side arm members each having an engaging portion extending from said rear side, said engaging portions being adapted to engage a corresponding retention member on said connector bottom section; and when viewed from the front, said crossbar lower side intersecting said side arm inner sides at obtuse angles.

2. The connector according to claim 1, wherein said crossbar member further comprises an inwardly projecting recess which intersects said lower side of said crossbar member.

3. The connector according to claim 1, wherein said obtuse angle is between about 100 degrees and 120 degrees.

4. The connector according to claim 1, wherein said obtuse angle is about 110 degrees.

5. The connector according to claim 1, wherein said top section comprises a wire retention portion having a front face and a rear side, said front face having a bottom edge, a top edge and two opposite sides, said front face being sloped inward such that said bottom edge is farther from said rear side than is said top edge, said sloped front face defining a portion of a tactile feedback area within which a portion of a digit of a user may rest when operating said connector.

6. The connector according to claim 1, wherein said connector is mounted to a connector block as part of an array of connectors.

7. The connector according to claim 6, wherein said connector block is mounted within a wiring junction box.

8. The connector according to claim 7, wherein said junction box is a building entrance protector.

9. The connector according to claim 7, wherein said junction box is a network interface unit.

10. A latch for use with a tool-less insulation displacement connector, said latch comprising:

a crossbar member extending between two downwardly projecting side arm members; said crossbar member having an upper side and a lower side, and said side arm members each having an outer side, an inner side, a front side and a rear side;

said side arm members each having an engaging portion extending from said rear side, said engaging portions being adapted to engage a corresponding retention member on said connector bottom section; and when viewed from the front, said crossbar lower side intersecting said side arm inner sides at obtuse angles.

11. The latch according to claim 10, wherein said crossbar member further comprises an inwardly projecting recess which intersects said lower side of said crossbar member.

12. The latch according to claim 10, wherein said obtuse angle is between about 100 degrees and 120 degrees.

13. The latch according to claim 10, wherein said obtuse angle is about 110 degrees.

* * * * *